US005154038A

United States Patent [19]

Capaci

[11] Patent Number: 5,154,038

[45] Date of Patent: Oct. 13, 1992

[54] APPARATUS AND METHOD FOR SEPARATING NEWSPRINT FROM OTHER SHEET MATERIAL AND WRAPPER FOR BUNDLE PRODUCED THEREBY

[76] Inventor: Anthony C. Capaci, 1306 Faulkner Ct., Mahwah, N.J. 07430

[21] Appl. No.: 746,567

[22] Filed: Aug. 16, 1991

[51] Int. Cl.[5] ..... B65B 11/02

[52] U.S. Cl. ..... 53/397; 53/447; 53/390; 209/680

[58] Field of Search ..... 53/397, 399, 447, 390, 53/540, 585; 209/680, 682, 703, 707

[56] References Cited

U.S. PATENT DOCUMENTS

| | | | |
|---|---|---|---|
| 2,026,284 | 12/1935 | Metternich | 53/585 X |
| 2,106,276 | 1/1938 | Sheineman | 53/397 |
| 3,135,387 | 6/1964 | Garcia | 209/703 |
| 3,964,381 | 6/1976 | Coenen | 53/390 X |
| 4,385,481 | 5/1983 | Capawana | 53/504 X |

*Primary Examiner*—John Sipos
*Attorney, Agent, or Firm*—Samuelson & Jacob

[57] ABSTRACT

The invention is directed toward providing a method of separating newsprint and other sheet material prior to recycling the newsprint, apparatus for carrying out the method and a wrapper, formed of material which may be recycled with the newsprint, to be used in the method and apparatus of the invention. The invention is used by the individual householder and will serve to eliminate many intermediate steps in the recycling of newsprint.

4 Claims, 3 Drawing Sheets

APPARATUS AND METHOD FOR SEPARATING NEWSPRINT FROM OTHER SHEET MATERIAL AND WRAPPER FOR BUNDLE PRODUCED THEREBY

This invention relates to an apparatus and method for separating newsprint sheets from other sheet material. As an important part of the invention, the newsprint is bundled into a recyclable package wherein the bundling package, to which the invention relates, is compatibly recyclable with the newsprint.

Presently, it has become necessary to recycle various materials. This need has arisen because of the overloading of land fills and other depositories of waste material and the growing depletion of our forests and other natural resources. As a natural result of use of the invention on a large scale, continued population growth may be attained without damaging the environment. Needless to say, new valuable industries will be spawned to aid in the recycling programs.

Newspaper sheets (newsprint) are recyclable and can be used to produce fresh newsprint or paperboard material such as chipboard. As a consequence, it has become very important to save old newsprint for transportation to recycling or other distribution centers. Many statutes have been enacted to require the separation of recyclable materials from other trash and waste material.

These efforts have met with little to no success depending to a large extent on the enforcement program and on the individual members of the public. For example, in many cases, inadequate facilities are provided for apartment dwellers to properly separate the materials within the building or complex. The process of separating the recyclable materials from those which are not recyclable must start at the family level. If it doesn't start there, it is doomed to failure. It should be noted that the present methods of newsprint separation and bundling are completely manual. As a result they are very time consuming, inefficient and expensive.

This invention is directed toward assisting in the recycling of old newsprint. Present day newspapers are largely of a standard size, approximately ($11\frac{1}{2}'' \times 14''$). The size of the tabloid and of the full size newspapers are the same since the full size newspaper usually is folded in half. The sheet of an opened tabloid is the same size as one page of a full size newspaper. The critical dimensions for both these types of newsprint publications are the same for the purpose and objects of the instant invention.

Presently, many newspapers are delivered with advertising inserts which are generally printed on glossy stock and are referred to in the trade as "shineys" or "slipperies". These sheets cannot be readily recycled by the same processing method as the newsprint. Therefore, the slipperies and other nonrecyclable material must be separated from the newsprint before delivery to the processing plant.

A further drawback of the present system of recycling of newsprint resides in the fact that the newspaper stack usually must be tied. Generally, the pile or bundle is tied with string or twine. Neither of these materials are recyclable using the system which is usually used for recycling newsprint. As a result, one must resort to removing the string or twine prior to recycling which is wasteful in time and labor. Some of the string or twine is captured under the bundle. Thus, the efficiency of the recycling process is inhibited.

The resident, private home or apartment, must bundle the papers and tie the bundle to prevent the papers from spewing out. The tied bundles either are left at the curb to be picked up by a scavenger (municipal or private) or are left in a designated place on each floor of a large apartment building. Periodically, on schedule, the tied bundles from the apartment are set out at the curb. In some apartment buildings, the newspapers are left loose in a small crate or bin on each floor of the building. In this last case, the slipperies are generally removed and the newsprint is bundled and tied by a building employee.

After the tied bundles are picked up by the scavenger, they are delivered to a depot (municipal or private). The bundles are now untied, most of the cord or string is discarded and the slipperies are removed. The balance, namely, the newsprint, is collected and trucked to the recycling plant. At the recycling plant, the material is, generally, placed on a large conveyor and the slipperies and captured string or twine are removed by hand.

There are variations in the above procedure. For example, complete removal of the twine and of the slipperies may be carried out in the recycling plant by hand, prior to placing the material on the conveyor.

Clearly, it is to the advantage of all concerned to eliminate some of the steps which add to the waste in time and cost. The best way to do this is to separate the newsprint from the other sheet material at the start of the process and to bind or tie the newsprint bundles with material which may be recycled with the newsprint thus producing a bundle of compatibly recyclable materials (newsprint and wrapper) with a large saving in time and cost.

If this were done, the slipperies would be separated from the newsprint and the bundle would be secured with recyclable binding by the resident. Under present conditions, there are no practical systems or methods available to the resident. It is for this reason, that we are forced to use the expensive procedure which has been set forth above, in some detail.

Accordingly, it is an important object of the invention to provide an apparatus and a method to enable the resident to separate the slipperies from the newsprint easily and quickly.

It is a further object of the invention to provide the resident with means and a convenient and inexpensive method for binding the bundles with material which may be recycled with the newsprint.

It is a still further object of the invention to provide a bundle wrapper which may be recycled with the newsprint.

It is a still further object of the invention to provide an integral, durable and recyclable wrapper and straps to be used with the apparatus and method of the invention for securing each bundle.

It is also an object of the invention to provide a unitary wrapper comprising both a body member and straps for securing each bundle.

These and other objects, advantages, features and uses of my invention will be apparent during the course of the following description when taken in conjunction with the accompanying drawings wherein.

Figure 1:
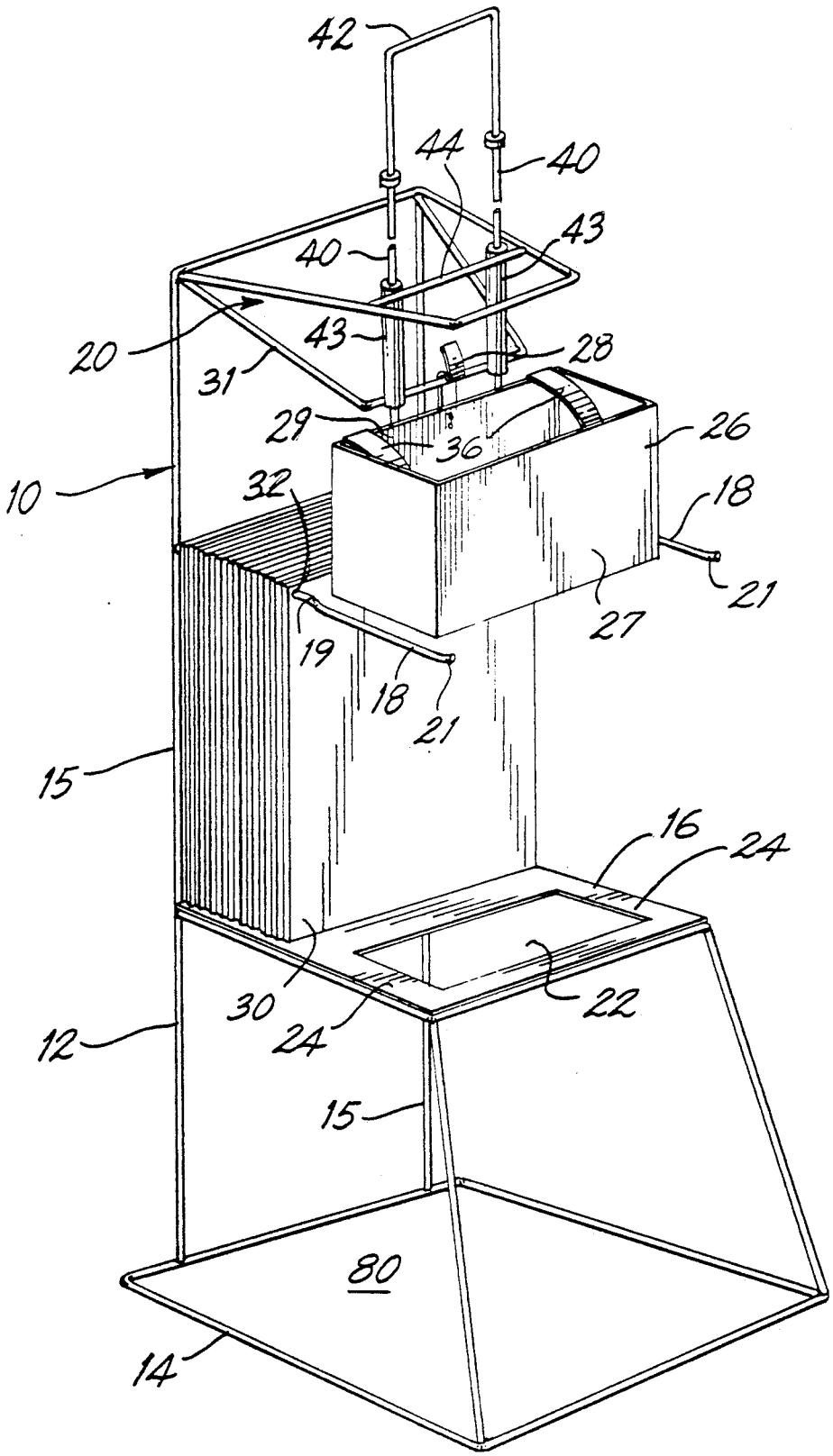
FIG. 1 is a view, in perspective, of a preferred embodiment of an apparatus of the invention.
Figure 2:
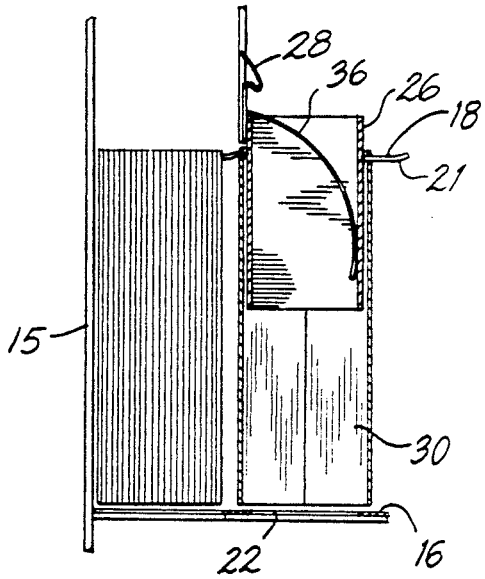
FIG. 2 is a side view, partly in section, of the upper portion of the apparatus of FIG. 1 showing a wrapper and the guide sleeve in place to receive sheets for separation.

In the drawings, wherein, for the purpose of illustration, there is shown a preferred embodiment of the invention, the numeral 10 designates an apparatus of the invention, generally. Apparatus 10 is seem to comprise a frame 12 having a base 14, upright vertical members 15, a support platform 16 extending outwardly from vertical members 15 and a pair of outwardly extending rods 18 above the support platform 16 and spaced therefrom. A top frame 20 is affixed to the upright vertical members 15 extending outwardly and above the rods or arms 18.

Figure 3:
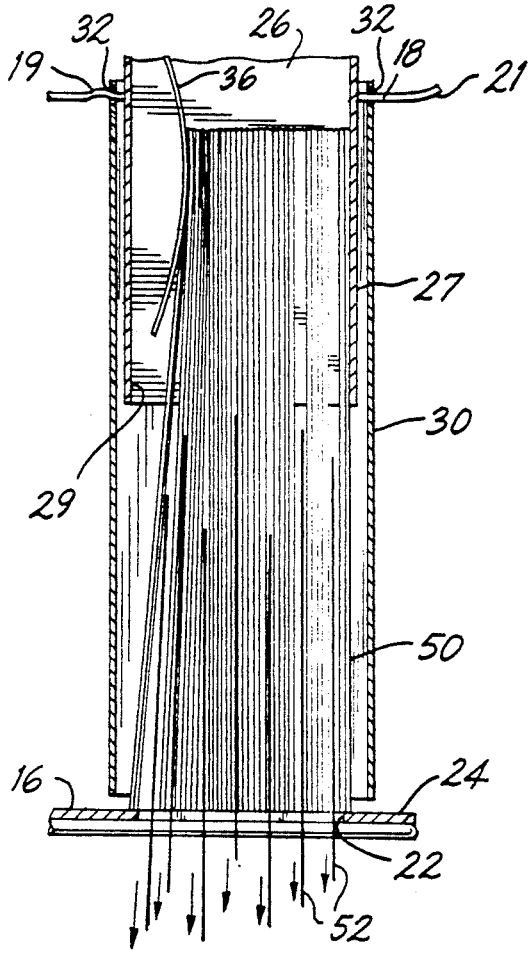
FIG. 3 is an enlarged view of that of FIG. 2, partly in section, showing the newsprint sheets being held in the apparatus and the smaller slipperies dropping into the discard area.
Figure 4:
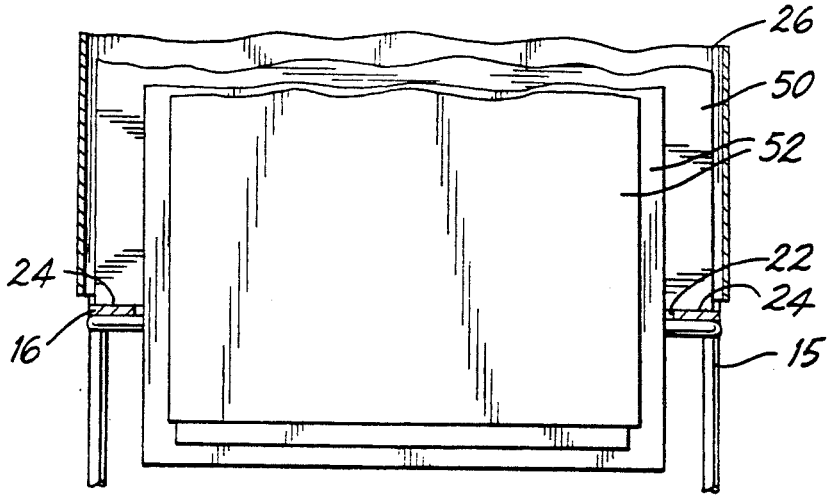
FIG. 4 is a front sectional view showing the slipperies dropping down and the newsprint sheets being held in place.

Support platform 16 is provided with an opening 22 therein which is dimensioned such that newsprint sheets 50 will rest on two side ledges 24 and the smaller slipperies 52 will drop through the opening 22 to a discard area 80 below the platform 16 (FIGS. 1, 3 and 4).

Figure 5:
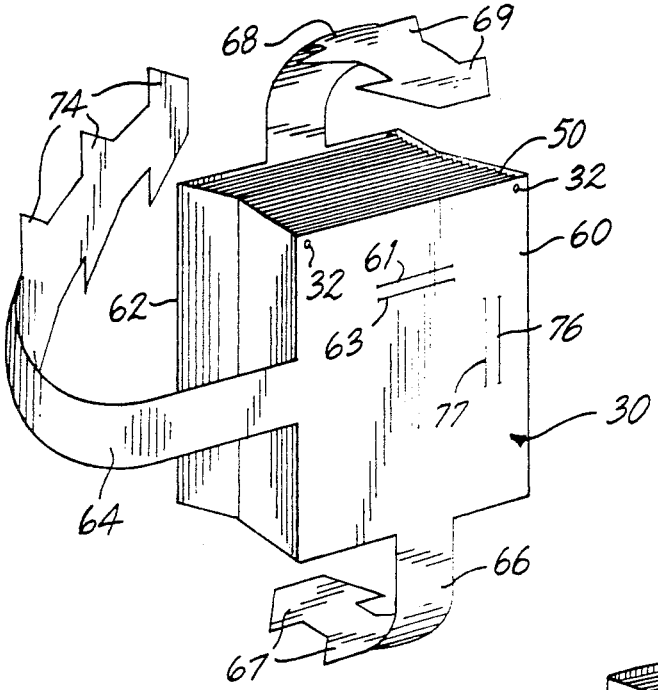
FIGS. 5, 6 and 7 show the steps in securing the newsprint in a wrapper of the invention.
Figure 6:
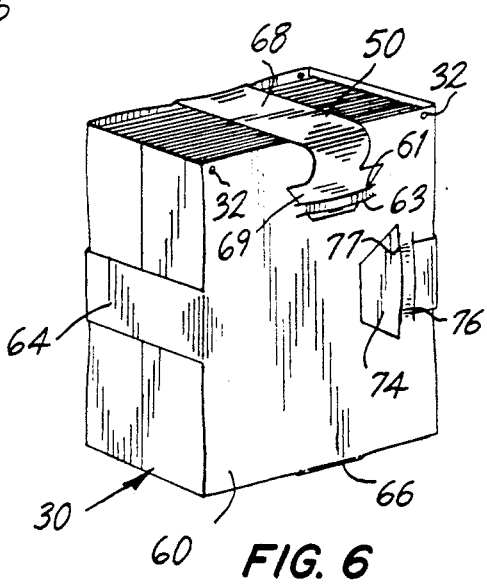
Figure 7:
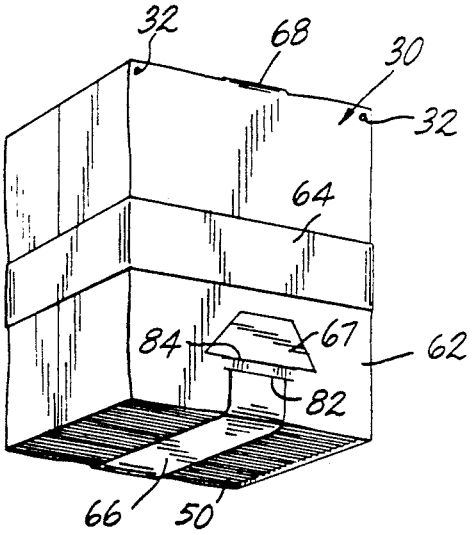

A plurality of folded wrappers 30 is mounted on the rods 18. Each wrapper 30 (best seen in FIGS. 5, 6, and 7) is provided with a pair of eyelets 32 on each of the two opposite faces of each wrapper 30. The plurality of wrappers is held in place by placing them on the rods 18 through the eyelets 32, and locating them behind a bump 19 on each arm 18. The plurality of wrappers 30 is kept in place behind the opening 22 in platform 16 and they are moved forward, over the bumps 19 one at a time so that the one, to be used, is in position over the opening 22 in the platform 16 and assumes the general shape of a parallelepipedic sleeve. The wrapper 30, which is in the forward, operative position is prevented from moving forward off the rods 18 by an upturned end 21 on the end of each of the rods 18.

In order, to hold the wrapper 30 open to receive sheets for separation, a guide sleeve 26 of rigid material is provided. Guide sleeve 26 is preferably in the shape of a parallelopiped with two opposite faces (top and bottom) removed. Once guide sleeve 26 is in place, the wrapper will not move. When the apparatus is not in use, guide sleeve 26 is held in its upper position by means of a latch 28 which coacts with a support 31 of top frame 20. In FIG. 1, the guide sleeve is shown in its upper or clear position.

Guide sleeve 26 comprises a front face 27 and a rear face 29 and is provided with two vertical, slidable, vertical rods 40 which are joined at the top by element 42. The lower portion of rods 40 are affixed to guide sleeve 26. Two tubes 43 are affixed to a bar 44 which is a part of top frame 20 so that guide sleeve 26 will drop down to the proper position when latch 28 is released.

A pair of springs 36 are affixed to rear face 29 and are biased such that they are urged toward the interior of the front face 27 near the edges thereof. Thus, the sheets which are supported on ledges 24 will be held firmly in place against the front face 27 of guide sleeve 26. The smaller shineys or slipperies 52 will not be held by the springs 36. They will drop through the opening 22 to discard area 80. The slipperies drop due to either the force of gravity, vibration of apparatus 10 due to the weight of the contents or gentle rocking of apparatus 10.

The bundle is loaded by placing a sheet between the previously placed sheets and the springs 36 so that the newsprint sheets being bundled are held firmly in place against the front face 27 of the guide 26 close to the outermost edges of the inserted newsprint. By holding the newsprint sheets in this manner, the chance that a slippery will be held firmly in the wrapper is minimized. When the user is ready to remove a filled wrapper of newsprint from the ledge, a circumferential strap is used to hold the wrapper and its contents firmly after which the guide sleeve 26 is moved upward and is held by latch 28. The guide sleeve 26 is raised out of the wrapper by means of hanger element 42 and the wrapper is closed as is described further in this description.

Platform 16 is spaced above the base 14 to permit the slipperies 52 to be collected in discard area 80. A preferred elevation is one which permits a container or shopping bag to be placed under the opening 22 to catch the slipperies 52 and facilitate easy removal of them for disposal by recycling or otherwise depending upon the material and the availability of recycling systems for them.

The dimensions of the apparatus 10 set forth below are designed for the separation of newspaper sheets 50 and slipperies 52 which are presently in use. Folded, full-size newspaper and tabloid sheets are about $11\frac{1}{2}''$ wide and 14" long and the slipperies are usually smaller in both dimensions and almost always in the width dimension.

To accommodate the above dimensions of the sheets being processed the platform is $13\frac{1}{2}''$ wide and about 12" or more deep. Opening 22 is $10\frac{1}{4}''$ wide so that each support ledge 24 is $1\frac{5}{8}''$ wide. Thus, it can be seen that the newspaper sheets will rest securely on the support ledges 24 held firmly in the wrapper by springs 36.

The preferable dimensions of the wrapper 30 is $13\frac{1}{2}''$ wide and 17" high. Eyelets 32 on the front and back faces of wrapper 30 are each spaced 1" from the top and 1" from the side to accommodate for the newspaper material and the construction of the apparatus and wrapper of the invention.

To aid in the separation of the newsprint from the slipperies, the apparatus is rocked slightly from front to rear. This helps in separating slipperies (which may be clinging to newsprint sheets) from the newsprint sheets so that the slipperies drop into the discard area.

When the wrapper 30 is full, or must be removed, even if it is not full, the guide sleeve 26 is raised from inside the wrapper by means of element 42 and the bundle is removed from the platform by hand, taking care that the sheets don't fall out of the wrapper, as has been described above. Now, the bundle is secured, as will be described below, so that it may be delivered readily to the municipal collection units or other units in the recycling processing chain.

The wrapper 30 of the invention is seen to have a front face 60 and a back face 62. A strap 64 is preferably unitary with front face 60. The strap 64 has at least one wedge shaped taper 74 and surrounds the girth of a closed bundle by pulling it tightly around the bundle and engaging one of its plurality of wedge shaped tapers 74 in a pair of slots 76 and 77 in front 60. Now, the guide sleeve 26 is raised to its upper position and latched. The wrapper and its contents are removed from the support platform 16 while holding the bundle securely to avoid dropping the contents.

Strap 64 is pulled as tightly as possible around the bundle and one of the wedge shaped tapes 74 is inserted in a slot 76 and pulled out through slot 77. The appropriate wedge shaped taper 74 is used so that the bundle is held securely. If a taper, other than the one at the end of the strap is used, then the excess portion of the strap may be removed or tucked into the bundle.

A strap 66 which is preferably unitary with front face 60 is provided with at least one wedge shaped taper 67 at the end thereof. Strap 66 is pulled over an open end of the bundle and is held in place by placing an appropriate wedge shaped taper 67 of a plurality of tapers in slots 82 and 84 in back face 62. Similarly, a strap 68 which has at least one wedge shaped taper 69 and is preferably unitary with back face 62 is used by placing it over the other open end of the bundle and engaging the appropriate wedge shaped taper 69 in slots 61 and 63 on front face 60.

Since the bundle formed from wrapper 30 and the newsprint wrapped within it are made of recyclable material such as recycled newsprint, the total package can be delivered directly to a recycling plant. It is unnecessary to remove any string or cord so that the intermediate, wasteful handling of the bundles is dispensed with. This results in a great, convenient, saving in time, material and cost and increases the amount of recycling which will be done.

The invention, as described herein, is capable of variation and modification without departing from the spirit and scope of the invention as set forth in the appended claims.

I claim:

1. A method for preparing sheets comprised of newsprint and other sheet material for recycling by separating the newsprint from the other sheet material which comprises:

placing a wrapper, parallelepipedic in shape, of material compatibly recyclable with the newsprint and having an open top and bottom on an elevated support platform having a pair of ledges and an opening therebetween;

the opening having dimensions smaller than the newsprint sheets and larger than the other sheet material such that the bottom of the wrapper and the newsprint sheets will rest on the ledges;

placing the newsprint sheets and other sheet material in the wrapper and resting the newsprint sheets on the ledges while dropping the other, smaller sheets through the opening;

wrapping and securing the newsprint sheets in the wrapper such that the secured sheets are held within the wrapper and removing the wrapper and its contents from the support platform.

2. The invention of claim 1 including:

the step of placing a guide sleeve in the wrapper to facilitate holding the sheets in the wrapper in a substantially vertical attitude.

3. The invention of claim 2 including:

the step of shaking the platform to facilitate the dropping of the smaller sheets through the opening.

4. The invention of claim 1 including:

the step of shaking the platform to facilitate the dropping of the smaller sheets through the opening.

* * * * *